United States Patent [19]

Kiefer

[11] 4,173,038

[45] Oct. 30, 1979

[54] CHANGING IMAGE LIGHT DEVICE

[76] Inventor: Jeffrey N. Kiefer, Box 761, Arroyo Hondo, N. Mex. 87513

[21] Appl. No.: 829,196

[22] Filed: Aug. 30, 1977

[51] Int. Cl.[2] ..... A47G 33/16; F21P 3/06

[52] U.S. Cl. ..... 362/811; 362/35

[58] Field of Search ..... 362/35, 32, 351, 354, 362/360, 121, 122, 123, 124, 134, 227, 806, 811, 235, 252, 255; 40/33, 77, 477–480, 502, 579–580; 350/4, 5

[56] References Cited

U.S. PATENT DOCUMENTS

| | | | |
|---|---|---|---|
| 2,304,458 | 12/1942 | Hauskind | 362/356 |
| 2,398,974 | 4/1946 | Storm | 362/35 |
| 3,234,847 | 2/1966 | Williams | 362/806 X |
| 3,538,323 | 11/1970 | Ziegler | 362/806 |
| 3,651,319 | 3/1972 | Norris et al. | 362/811 X |
| 3,749,903 | 7/1973 | Belokin, Jr. | 362/811 X |
| 3,791,058 | 2/1974 | Mollica | 362/35 X |
| 3,808,721 | 5/1974 | Gersch | 40/33 |
| 3,923,368 | 12/1975 | Hassel | 350/4.1 |
| 3,949,350 | 4/1976 | Smith | 362/86 |

*Primary Examiner*—William M. Shoop
*Assistant Examiner*—Peter S. Wong
*Attorney, Agent, or Firm*—Clarence A. O'Brien; Harvey B. Jacobson

[57] ABSTRACT

A light device for projecting a variety of different images in various changing colors onto a translucent surface to provide the visual portion of audio visual entertainment. The primary embodiment has a box-like container with one or more sides of translucent mterial. An openable top cover permits ready access to the interior of the device which has mounted therein a support stand provided with a plurality of different color flashing lights. Mounted at the top of the support stand is an electric motor of very slow revolutions per minute, and mounted on the output shaft of said motor is a turntable-like disk member. Specially configured pyramidal programs are provided for interchangeable mounting on said disk member. The individual programs may be preformed in flat configuration with interlocking edge portions to enable assembly thereof. Appropriate letters and/or symbols are cut out of the flat program sheet prior to assembly thereof, for representing the desired visual experience by a user of the device. Each program includes a series of cutouts which may define a trip or series of visual experiences. Several embodiments of the device substitute an opaque globe structure for the box-like container, and are designed to be mounted on either a base member, or suspended from overhead structure by a support member.

6 Claims, 8 Drawing Figures

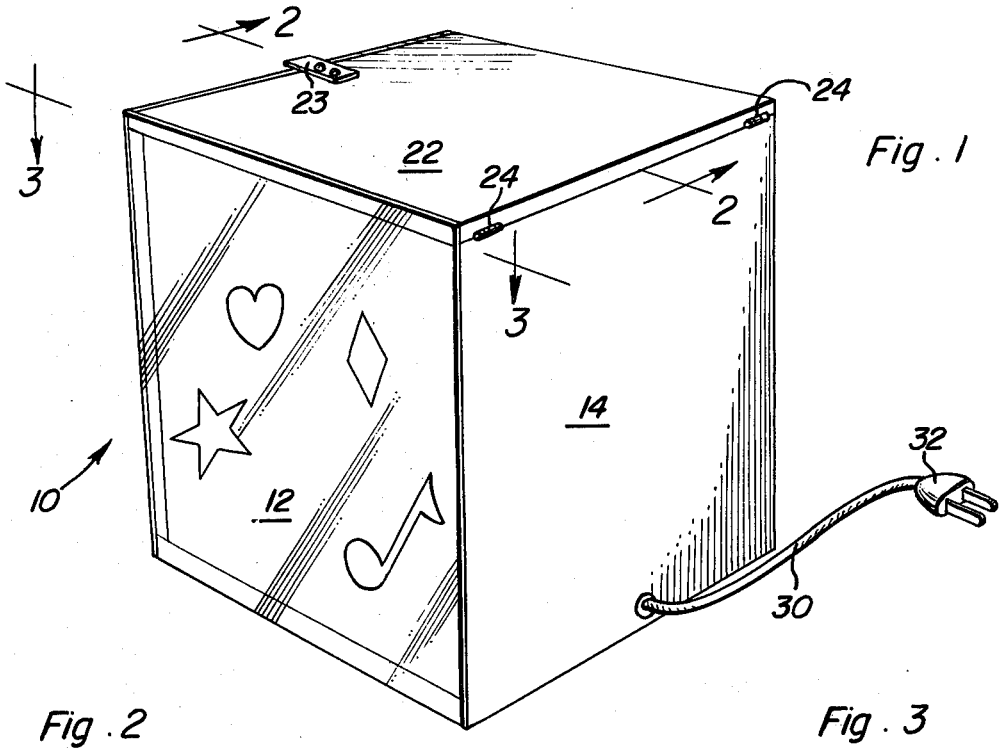
Fig. 1
Fig. 2
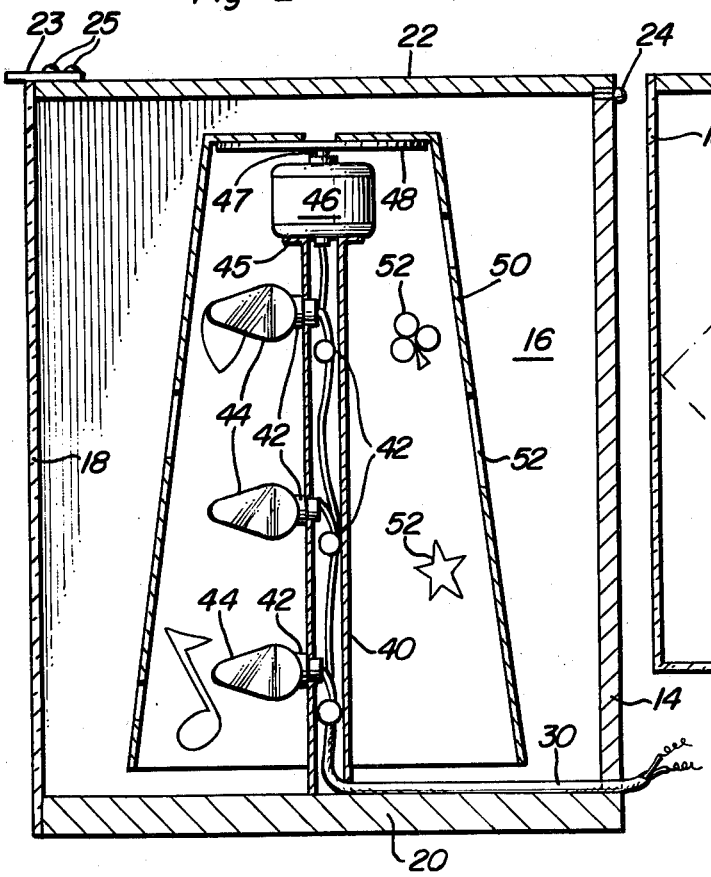
Fig. 3
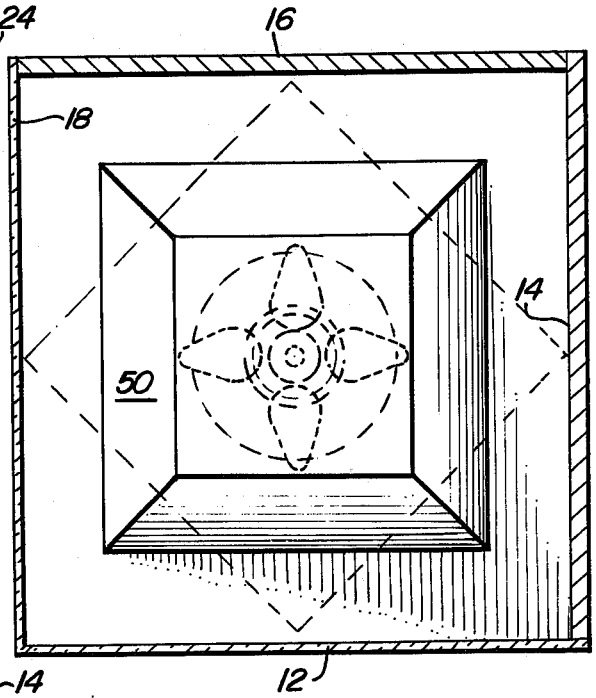

CHANGING IMAGE LIGHT DEVICE

BACKGROUND OF THE INVENTION

1. Field of the Invention

This invention relates generally to audio-visual entertainment with this device providing the visual portion in the form of a plurality of changing images in varying changing colors upon an associated translucent member.

2. Description of the Prior Art

It is known in the prior art to have lamps provided with revolving shade structure actuated by the convection currents caused by the heat of the lamp bulb so that the lamp shade will be slowly rotated to change a position of the lamp shade and the image inscribed thereon as viewed by an observer. An example of such a device is the patent to Palmieri, U.S. Pat. No. 2,611,071.

Another known type display device is illustrated in the patent to Birdsell et al, U.S. Pat. No. 2,039,770. In this patent a drum structure having images provided thereon is slowly rotated by means of an electric hysteresis type motor. Light bulbs provided within the drum illuminate the images thereon. A problem with this type device is that the drum must be provided with a metal border in order for the hysteresis-type motor to function. This greatly limits the changeability of the drum and therefore the changeability of the images which a user can view.

Another problem with known type devices is that they do not offer a good variety of lights and changing colors created thereby, nor do they provide structure for quick and easy changeability of the program of images to be illuminated by said changing colored lights.

Other known prior art devices which may be pertinent to this invention are listed as follows:

U.S. Pat. No. 2,876,339
U.S. Pat. No. 3,686,494
U.S. Pat. No. 3,242,332
U.S. Pat. No. 3,701,897

None of these devices offers the new and novel features of the invention disclosed herein.

SUMMARY OF THE INVENTION

An object of the present invention is to provide a light device having means for producing an ever changing pattern of images in various changing colors on a translucent structure associated therewith.

Another object of this invention is to provide a light device for producing images on a translucent surface wherein the images produced are created by a trip pattern structure which may be easily changed to vary the images produced.

Another object of this invention is to provide a light device having changeable trip program members which may be produced and distributed in flat form and assembled in an erect form by the user of the device when desired. Various sizes, shapes, and styles of images to be projected by the light device may be precut into the trip program, or blank program members may be provided for the user to make up his own trip program.

A further object of this invention is to provide a box-like container having at least one side of translucent material and an easily openable lid associated with the container to permit ready access to the interior thereof for changing the programs thereof. A constant slow speed revolution per minute drive structure together with a multiple number of different colored flashing lights are provided within the container and for association with the trip program.

An additional further object is to provide light devices which may be supported by tables or the like, as well as devices which may be suspended or mounted from overhead structure such as existing ceiling lights and the like.

The invention disclosed herein has a number of new and unique features associated therewith. This invention consists of a light device including a support for a multiplicity of colored lights arranged so as to alternately flash on and off. This results in a constantly changing colored illumination being emitted from the light structure. A support tube is used to mount the lights and also mount on one end thereof a slow revolution per minute electric drive motor. Mounted on the output shaft of said drive motor is a disk-like turntable member which supports changeable trip programs. These trip programs preferably are formed in flat shape by die cutting or the like to provide fold line portions, slits between projecting portions at the end of each fold portions, interlocking slots, and interlocking projections and tabs to associate and interengage with said slots. Also formed therewith are letters or symbols of desired shapes and sizes which make up the program. The primary embodiment mounts the structure in a box-like container having an openable lid and at least one translucent side. Other embodiments replace the box-like container with a translucent globe structure for permitting the images to be projected over approximately 360 degrees of the surface thereof. These embodiments are provided to be either table mounted or mounted from overhead structure.

These, together with other objects and advantages which will become subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the light device of this invention.

FIG. 2 is a side elevational view, partly in cross section, taken generally along lines 2—2 of FIG. 1.

FIG. 3 is a plan view, partly in cross section, taken generally along line 3—3 of FIG. 1.

DESCRIPTION OF THE PREFERRED EMBODIMENT

Figure 4:
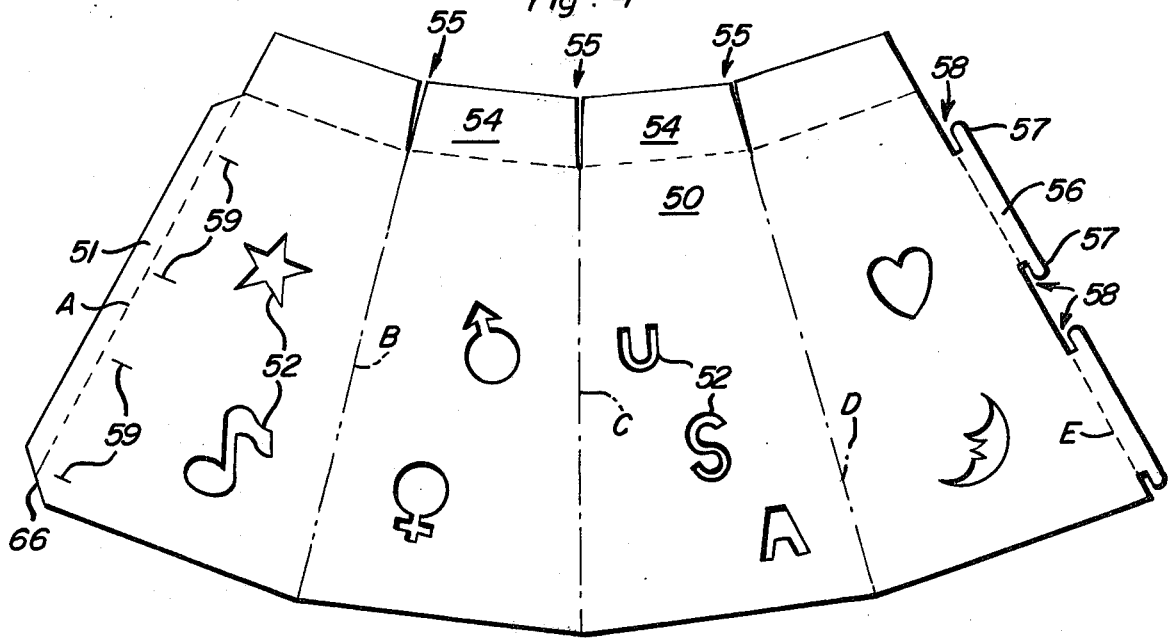
FIG. 4 is a view of the flat unassembled trip program per se.

Referring to FIG. 1 of the drawings, reference numeral 10 indicates in general the light device of this invention. As shown in FIGS. 1, 2 and 3, a box-like container is provided having four side walls 12, 14, 16 and 18. At least one of said side walls is made of transparent material preferably of a light diffusing type through which images projected thereon may be viewed. As shown in FIG. 3, walls 12 and 18 are of such translucent material, while walls 14 and 16 are of solid opaque material. This invention envisions having a single wall of translucent material as well as all four walls of such material. A solid bottom member 20 supports the four sidewalls and a top cover 22 is hinged along one edge thereof by hinges 24 of any conventional type. Provided at the opposite edge of the top cover is a projection 23 to form a closure stop as well as a lifting tab. Small screws 25 through appropriate apertures may be used to secure the tab 23 to the edge of the top cover. Centrally mounted on the base 20 is a support stand 40 attached to the base by any suitable means, not shown, for supporting thereon a plurality of light sockets 42. These light sockets 42 are connected by appropriate electrical wiring 30 having a plug 32 thereon for connection to a normal consumer electrical line. Light bulbs 44, preferably of different colors are mounted in the sockets 42. Preferably at least three sockets and bulbs are mounted vertically along support tube 40 at each of four evenly spaced areas as best seen in the top view of FIG. 3. The sockets normally are also spaced equally along the vertical direction of the support 40 as best seen in FIG. 2 (note only two sets of these lights are shown in this Figure.) The bulbs 44 are arranged to flash or turn on intermittently which may be effected by using bulbs 44 of the Christmas tree type which have built in flashing mechanism as part of the bulb itself. These Christmas tree light bulbs are readily available in a variety of colors and come equipped with the built in flashing mechanism, so are ideal for use with this light device. However, if preferred, the bulbs 44 may be of conventional non-flashing type and appropriate flashing mechanism built into the sockets 42. Conventional flasher-type sockets are also readily available commercially and wound in this case be the type used.

Mounted at the top end of the support 40 by appropriate fastener flanges 45 is an electric motor 46. This motor 46 is of the slow revolution per minute type and includes any necessary reduction gearing therewithin to produce a slow revolution output at the shaft 47. Preferably, the shaft 47 will rotate at approximately 1 rpm (revolution per minute). Mounted on the end of output shaft 47 is a turntable-type disk member 48 having thereon any suitable slip resistant surface for the purpose of drivingly engaging with the top portion of the trip program structure.

The trip program structure basically is made from a flat piece of material such as posterboard or the like. Looking at FIG. 4, the preferred shape of such structure prior to assembly may be seen. The basic program 50 is preferably die cut from said posterboard material in the shape as shown. Fold lines A, B, C, D and E may be partially cut, or indicia may be printed therealong for indicating the proper fold points. An extending flap 51 is provided along the outer fold line A, while extending tab projections 56 are provided along the other outer fold line E. The tab projections 56 have other small tabs 57 provided at either side thereof forming recesses 58 with the main body of the program sheet. Slots 59 are provided along the fold line A at the other end of the program sheet which as can be readily visualized, and may be best seen in FIG. 5, from the interlocking connection when the program is assembled. The small tabs 57 slide into the slots 59 and thus maintain the program in the erected form. As illustrated, this trip program structure as erected forms a truncated pyramid. This four-sided pyramidal shape produces the desired effect as the program is slowly rotated within the cabinet structure, best seen by the dotted lines in the plan view of FIG. 3. While as shown in FIG. 3, four strings of three vertical lights are provided, three or even two vertical strings may be used. Preferably, at least two vertical strings are used to create the desired effect, a single vertical string of three lights having been discovered as not producing nearly as good an effect as three or four vertical strings.

Suitable symbols and letters 52 are preferably die cut or otherwise formed at the same time as the basic program structure 50 is formed. However, in some cases, unfinished program structures may be supplied to the ultimate user of the device for making their own trip programs. In such case the shape of the structure would be as in FIG. 4, however, the panel portions would be left blank with only the fold lines, the interlocking slots 59, and projections 56 with interlocking tabs 57 provided. Flaps 54 also are provided with the respective panel members and are formed by cutting slots 55 in alignment with the fold lines as shown. Normally when the device is assembled, these top flaps 54 will be folded or interwoven in the manner best illustrated in FIG. 5. That is, with the edge of one flap under the next flap and then with the other edge of the next flap under the adjacent edge of the third flap, etc. This interweaving of the flaps 54 together with the interlocking tabs 57 and slots 59 maintains the trip program as assembled. The cut-off portion 66 permits the open edges to be closely secured together when the device is assembled.

Figure 6:
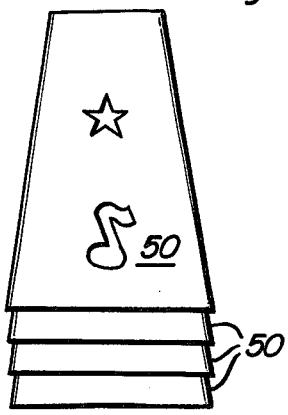
FIG. 6 is a side elevational view of several assembled trip programs as stacked one upon another.

Once assembled, a plurality of trip programs may be stacked in the manner shown in FIG. 6 to conserve space during storage. However, for maximum conservation of space, and for ease of transportation and distribution, normally the trip program structure will be handled in the flat form of FIG. 4. Also, these trip programs may be supplied with musical records and albums with appropriate symbols and other indicia provided thereon to correspond with the music of the records.

Figure 5:
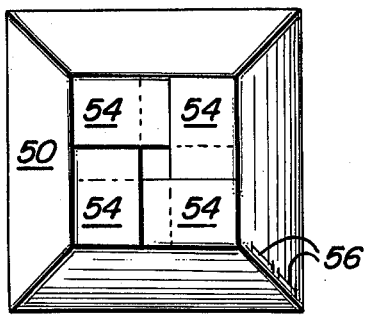
FIG. 5 is a top view of an assembled trip program.

In operation, a user of the light device of this invention will assemble the appropriate trip programs into the form of FIGS. 5 and 6, and then open the top cover 22 and slip the truncated pyramid structure over the drive turntable 48 for support and drive thereby. The motor 46 upon energization thereof by plugging plug 32 into a suitable outlet, or by turning on a switch which may be provided in the electric line 30 (not shown), will cause rotation of the turntable 48 at about 1 rpm and the lights 44 simultaneously energized with the motor will alternately turn on and off to produce a kaleidoscopic effect of varying lights, colors, and images upon the translucent panels 12 and 18. As can be readily imagined, if the lights and symbols on the screens 12 and 18 represent the music being played from an associated player equipment, the user of the device can experience a very pleasant and enjoyable audio-visual experience or entertainment. Also, it has been discovered in actual operation that the effect of the changing images and colors appears to keep time with the music.

Figure 7:
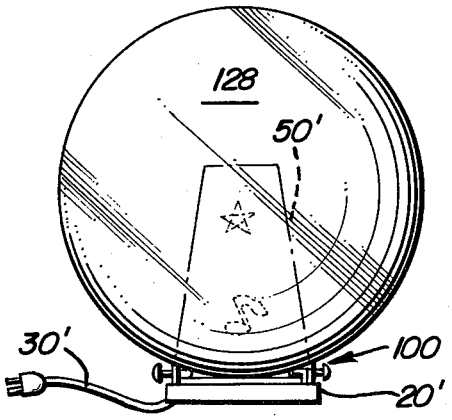
FIG. 7 is an elevational view of a modified embodiment of the invention.

FIG. 7 shows a modified embodiment wherein the box-like container structure described above is replaced with a translucent globe 128. A connecting electric cable 30′ feeds through a base support 20′ for operation of the internal light and motor structure (not shown) but inside of the trip program 50′. The connection portion 100 of any suitable construction (such as three or more adjusting and holding screws) connects the globe 128 to the base 20′. The internal operating mechanism is similar to that of the above embodiment, but the globe 128 must be removed each time the trip program is changed. However, a very desirable benefit of this embodiment is in the fact that the entire inner surface of the translucent globe 128 is provided with the changing colored images and therefore permits a 360 degree area for viewing of the device. Thus, this embodiment could be used for large audiences, large assemblies of friends in a single room, etc.

Figure 8:
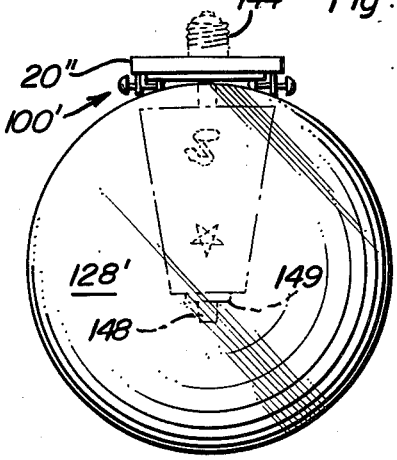
FIG. 8 is an elevational view of another embodiment of the invention.

FIG. 8 shows another embodiment of the invention wherein the structure of FIG. 7 is further modified so that the device may be mounted from overhead structure such as a ceiling light outlet or the like. In this embodiment, the electric cord 30' has been replaced with a light bulb-type base member 144 which can screw directly into conventional-type light sockets. The base 20'' may be suitably fastened to the ceiling associated with the ceiling light or otherwise positively secured to overhead structure to prevent inadvertent loosening and falling of the device. However, the member 144 can be designed to fully support the device. A connecting portion 100' also is provided to permit secure and safe attachment of the globe 128' to the base 20'', but yet permitting quick and easy removal of the translucent globe to permit a change of trip program. The trip program being in the inverted position this embodiment must be provided with structure for retaining same against the drive turntable. This is accomplished by an extension stud 148 appropriately secured to the center of the turntable and a locking nut 149 for the purpose of securing the trip program tightly to the turntable. With this embodiment, again a 360 degree projection and viewing of the images with changing colored lights is provided. This overall produces a very pleasing and satisfying kaleidoscopic effect. This embodiment also may be used similar to the dance ballroom revolving lights of yesteryear.

This invention also contemplates the use of multiple lights, motors and programs enclosed within a single unit which would increase the variety of images and would provide many different patterns which could be spread across a broad screen such as completely across the width of a juke box or the like.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A light device comprising first means for producing a virtual kaleidoscope of images in various changing colors, and changeable program means associated with the first means for changing the type of images produced by the device, wherein the changeable program means includes an easily changeable program member of truncated pyramid shape of relatively lightweight material and having various symbols and letters removed therefrom to provide paths for light to pass therethrough and a program member of truncated pyramid shape formed from a flat die-cut piece of posterboard, the die-cuts provided to form the desired shape as well as folding edges thereof, and interlocking means folded therewith in order to maintain said program member in erected form once folded thereinto, said first means including a support structure having a plurality of colored lights thereon, flashing means associated therewith for causing said lights to alternately flash on and off, an electric motor mounted at one end of the support, said electric motor having an output means rotating at a slow rate, and turntable means connected to said output means for drivingly connecting the slowly rotating output means to said program means at the narrow portion of said pyramid shaped program member so as to permit quick and easy change thereof in order to vary the type of images presented for viewing.

2. The structure as set forth in claim 1, together with a box-like container having a bottom, four walls, at least one translucent panel forming at least one of said walls, and an openable lid to permit easy access to the interior of the container for the purpose of easy change of the program member.

3. The structure as set forth in claim 1, together with a base for holding the support structure in a vertical position thereon, a translucent globe removably mounted to said base, and means for quickly attaching and detaching said translucent globe from said base for the purpose of permitting change of the program member.

4. The structure as set forth in claim 1, together with a support structure for attachment to an overhead ceiling light fixture, a translucent globe removably attached to the overhead support structure, and means mounting the globe to the overhead support means for permitting quick and easy removal of the globe in order to change the program member of the device and yet assuring positive securing of the globe to the overhead support structure, and means for positively securing the program member to the associated drive structure.

5. The structure as set forth in claim 1, wherein the plurality of colored lights comprise at least three light sockets with bulbs mounted therein mounted vertically, and at least two of said vertical sets mounted on said support at different positions thereon.

6. The structure as set forth in claim 5, wherein a total of four vertical sets of lights are mounted on the support structure and spaced equally therearound, and the means for flashing said lights alternately on and off consists of self-contained flashers in the light bulbs themselves.

* * * * *